US005445473A

United States Patent [19]

Chaverot et al.

[11] Patent Number: 5,445,473

[45] Date of Patent: Aug. 29, 1995

[54] CRACK ANTI-RISE SYSTEM INSERTED BETWEEN THE STRUCTURAL LAYER AND THE ROAD CARPET OF A CARRIAGEWAY AND PROCESS FOR PRODUCING SUCH A SYSTEM

[75] Inventors: Pierre Chaverot, rue Salvador Allende; Emile Lopez, Impasse Sainte Blandine, both of France

[73] Assignee: Koch Materials Company, Wichita, Kans.

[21] Appl. No.: 204,178

[22] PCT Filed: Jul. 5, 1993

[86] PCT No.: PCT/FR93/00690

§ 371 Date: Apr. 25, 1994

§ 102(e) Date: Apr. 25, 1994

[87] PCT Pub. No.: WO94/01623

PCT Pub. Date: Jan. 20, 1994

[30] Foreign Application Priority Data

Jul. 7, 1992 [FR] France ..... 92 08366

[51] Int. Cl.[6] ..... E01C 7/00

[52] U.S. Cl. ..... 404/75

[58] Field of Search ..... 404/72–75, 404/90–92

[56] References Cited

U.S. PATENT DOCUMENTS 4,650,820 3/1987 Decroix ..... 404/75

5,290,123 3/1994 Barnes et al. ..... 404/75

FOREIGN PATENT DOCUMENTS 2592411 7/1987 France .

OTHER PUBLICATIONS

Highways, vol. 58, No. 1959, Jan. 1990, Croydon GB, pp. 12–14 Buist & Ineson Geogrids in Reinforcing Asphaltic Pavements.

*Primary Examiner*—Michael Powell Buiz

*Attorney, Agent, or Firm*—Burgess, Ryan and Wayne

[57] ABSTRACT

A rising crack prevention system between the structural and wearing courses of a roadway is provided which includes a geotextile layer impregnated with a first asphalt binder, and further includes a layer of roadstones coated with a second asphalt binder adjacent to the geotextile layer impregnated with the first asphalt binder. The unique double-layer construction of the rising crack prevention system is efficient in preventing or at least greatly slowing down the spread of cracks from the structural course to the wearing course of the road.

28 Claims, No Drawings

CRACK ANTI-RISE SYSTEM INSERTED BETWEEN THE STRUCTURAL LAYER AND THE ROAD CARPET OF A CARRIAGEWAY AND PROCESS FOR PRODUCING SUCH A SYSTEM

The invention relates to an improved crack anti-rise system inserted between the structural layer and the road carpet of a carriageway. It further relates to a process for producing such a system.

Road or airport carriageways are generally formed from a number of layers, namely a surface layer, known as the road carpet, based on a material of the surface coating type or alternatively of the bituminous concrete type, and one or a number of lower layers forming the structural layer of the carriageway, based on materials treated with hydraulic binders such as cements, blast furnace slags, pozzolana, fly ash or bituaninous binders.

For structures containing hydraulic binders, various mechanical and thermal stresses of static nature, for example setting contraction and thermal contraction of the materials, or of dynamic nature, namely stresses related to traffic, to which carriageways are subjected lead to cracking of the structural layer, the cracks generated being transmitted more or less rapidly to the road carpet to then appear at the surface of the latter. The presence of surface cracks in the carriageway makes it possible for water to enter into the body of the said carriageway, which causes rapid and significant deterioration of the latter.

In order to prevent or at least delay the appearance of cracks in the road carpet of a carriageway, the structural layer of which is subjected to cracking, various solutions have been proposed, such as:

- creation of an interface consisting of a membrane made of asphalt/rubber run onto the structural layer in order to uncouple the movements of the latter and those of the road carpet which surmounts it,
- transverse bracing of the surface bituminous concrete layers by polyester grids having satisfactory mechanical characteristics, or alternatively
- depositing a polyester nonwoven on the cracked structural layer and then covering the nonwoven with a layer of approximately five centimeters of a bituminous concrete which constitutes the road carpet.

Such solutions have not led to satisfactory results, the cracks reappearing more or less rapidly at the surface.

A better solution, proposed in the citation FR-A-2,592,411, consists in interposing, between the structural layer and the road carpet, a nonwoven geotextile interface impregnated with a bituminous binder consisting of an asphalt modified, for example, by a copolymer of styrene and of a conjugated diene such as butadiene.

It has now been found that the behaviour of the crack anti-rise systems of the type of that described in the citation FR-A-2,592,411 could be improved by joining a layer of aggregates coated with a bituminous binder to the geotextile layer, itself impregnated with a bituminous binder.

The crack anti-rise system according to the invention, which is inserted between the structural layer and the road carpet of a carriageway, is of the type containing a layer of a geotextile impregnated with a first bituminous binder and it is characterized in that it also includes a layer of aggregates coated with a second bituminous binder, which is joined to the layer of geotextile impregnated with a first bituminous binder.

According to a first embodiment, the crack anti-rise system is arranged so that, between the structural layer and the road carpet of the carriageway, the layer of geotextile impregnated with the first bituminous binder lies on the structural layer of the carriageway, whereas the layer of aggregates coated with the second bituminous binder is covered by the road carpet.

According to a second embodiment, the crack anti-rise system is arranged so that, between the structural layer and the road carpet of the carriageway, the layer of aggregates coated with the second bituminous binder lies on the structural layer of the carriageway, whereas the layer of geotextile impregnated with the first bituminous binder is covered by the road carpet.

The layer of aggregates coated with the second bituminous binder can advantageously be a layer of sand coated with the said binder. The layer of aggregates coated with the second bituminous binder can also consist of a layer of a surfacing run on while cold or alternatively of a draining surfacing layer.

Geotextile is understood to mean, according to the invention, any tightly-structured textile sheet which is produced from natural or synthetic fibres or yarns and which is commonly used in road construction and land stabilization operations. Advantageously, the geotextile used according to the invention consists of a nonwoven sheet formed from continuous filaments based on a polymer such as polyester, isotactic polypropylene, polyamide, polyacrylonitrile, cellulose acetate, poly(vinyl chloride) or poly(vinylidene chloride). A geotextile consisting of a tightly-structured nonwoven sheet formed from continuous filaments based on isotactic polypropylene, or else on a polyester, especially poly(alkylene terephthalate) such as poly(ethylene terephthalate), or alternatively on a polyamide, especially Nylon-6 or Nylon-6,6, is very especially suitable. The nonwoven sheet formed from continuous filaments based on a polymer can be, in particular, the sheet described in one or other of the citations FR-A-1,601,049, FR-A-2,108,145 and FR-A-2,592,411, the said citations showing the general method for the production of such a sheet.

The mass per unit area of the textile sheet constituting the geotextile can vary fairly widely and advantageously lies between 50 and 500 g/m$^2$. For example, when the textile sheet has the structure of the sheet described in the citation FR-A-2,592,411, the mass per unit area of the said textile sheet is preferably between 100 and 300 g/m$^2$.

The first bituminous binder, which impregnates the geotextile in order to constitute the impregnated geotextile layer of the crack anti-rise system, is advantageously used in an amount of between 200 g and 1,500 g and preferably between 300 g and 1,000 g per square meter of geotextile sheet.

The second bituminous binder, in combination with the aggregates, in order to form the coated aggregates layer of the crack anti-rise system, is used in an amount advantageously of between 3 and 20% and more particularly between 4 and 12% of the weight of the aggregates.

In the "sand coated with the second bituminous binder" variant, the aggregate component can be chosen from the various sands which are used on roadworks and for which the proportion passing through a 6 mm sieve is greater than 80% and preferably equal to 100%.

In the "surfacing run on while cold" variant, the aggregate component, chosen from the sands which are used on roadworks and for which the proportion passing through a 6 mm sieve is greater than 80%, is coated with the second bituminous binder, used as an aqueous emulsion, after having been brought into contact beforehand with a surface-active solution and optionally with an amount of cement of less than 3% of the weight of the sand forming the aggregate component.

In the "draining surfacing" variant, the aggregate component, chosen from chippings which are used on roadworks and for which the proportion passing through a 20 mm sieve is greater than 90%, is coated while hot with the second bituminous binder so as to provide, after compacting, a void content in the surfacing of between 15% and 35% and preferably between 20% and 30%.

The first bituminous binder, which impregnates the geotextile, and the second bituminous binder, which coats the aggregates, can be identical or different in nature and are chosen from asphalts and asphalts modified by polymers which have a dynamic viscosity at 100° C. of between 0.4 Pa.s and 25 Pa.s and preferably between 0.7 Pa.s and 20 Pa.s. The first and second bituminous binders can be chosen in particular from asphalts modified by copolymers of styrene and of a conjugated diene and very especially from asphalts modified by block copolymers of styrene and of a conjugated diene such as butadiene, isoprene or carboxylated butadiene, the preparation of which is described in the citations FR-A-2,376,188, FR-A-2,429,241, FR-A-2,528,439 and FR-A-2,636,340.

In order to impregnate the geotextile or to coat the aggregates with the chosen bituminous binder, the latter can be used either in the molten state or alternatively in the form of an aqueous emulsion, for example an emulsion described in one or other of the citations FR-A-2,517,317, FR-A-2,577,545 and FR-A-2,577,546.

In order to produce a crack anti-rise system according to the invention, inserted between the structural layer and the road carpet of a carriageway, the said system containing a layer of a geotextile impregnated with a first bituminous binder and joined to a layer of aggregates coated with a second bituminous binder, one of the layers of the crack anti-rise system is applied to the structural layer of the carriageway, the layer thus formed is then covered using the other layer of the crack anti-rise system and the road carpet is applied to the construction thus formed.

According to a first embodiment, the layer of geotextile impregnated with the first bituminous binder is first of all applied to the structural layer of the carriageway, the said geotextile layer is then covered with the layer of aggregates coated with the second bituminous binder and the road carpet of the carriageway is applied to this last layer.

According to a second embodiment, the layer of aggregates coated with the second bituminous binder is first of all applied to the structural layer of the carriageway, the said layer of coated aggregates is then covered with the layer of geotextile impregnated with the first bituminous binder and the road carpet of the carriageway is applied to this last layer.

The road carpet of the carriageway, which lies on the crack anti-rise system, can be of any type known in the art, the binder used for this road carpet being a pure asphalt or alternatively an asphalt modified by a polymer and especially by a copolymer of styrene and of a conjugated diene such as butadiene, isoprene or carboxylated butadiene.

When the structural layer of the carriageway is cracked, it is useful to block up the widest cracks, for example cracks with a width greater than 2 mm, using a bridging agent consisting of a bituminous mastic before applying the first layer, namely impregnated geotextile or coated aggregates depending on the case, of the crack anti-rise system to the said structural layer.

The layer of aggregates coated with the second bituminous binder which constitutes one of the two layers of the crack anti-rise system according to the invention has a thickness which can be between 1 cm and 6 cm.

The invention is illustrated by the following examples given without implied limitation.

EXAMPLES 1 TO 3

In these examples, studies are carried out on the propagation of cracks in test pieces which simulate a carriageway structure containing or not containing a crack anti-rise system.

The test pieces used each consisted of a rectangular multi-layer plate, the said plate having a length of 560 mm and a width of 110 mm and containing a substrate layer precracked along its transverse axis simulating the cracked structural layer of a carriageway and a visible layer simulating the road carpet of the carriageway, the latter layer lying directly on the precracked substrate layer or being separated from this substrate layer by a crack anti-rise system.

By using the said test pieces, tests were carried out to determine the rate of rise of the crack from the substrate layer into the layer of the test piece simulating the road carpet.

These tests were carried out on a contraction-bending test machine containing a flat stationary support component and a flat support component able to move with translational motion, together defining a flat support plane. The test piece subjected to test was mounted on the test machine so that one of the halves of the free face of the transversely precracked substrate layer of the test piece was bonded to one of the flat support components and that the other of the said halves was bonded to the other of the said flat support components.

Each test piece mounted on the test machine was subjected, under constant temperature conditions (operation at a temperature of 5° C.), simultaneously to two types of stress, namely

- a slow continuous longitudinal traction, with a rate of 5 μm per minute, simulating thermal contraction, and
- cyclical vertical bending, at a frequency of 1 Hz, simulating traffic.

The progression of the crack into the layer of the test piece simulating the road carpet was monitored using a network of electrically-conductive wires bonded at different heights to the edge of the said layer in the region of this edge where the crack should grow so that the rise of the crack into the layer causes these wires to be successively cut, the position of the cut wires being recorded as a function of the stress time of the test piece.

The time $t_{R2}$, at the end of which the crack had risen by 2 cm into the road carpet, was determined on the curve thus obtained, representative of the propagation of the crack as a function of time.

The test pieces used during the tests had the following structures:

EXAMPLE 1: Two-layer test pieces not containing the crack anti-rise system, the said test pieces being formed from a precracked substrate layer with a thickness of 15 mm directly surmounted by a road carpet with a thickness of 50 mm.

EXAMPLE 2: Test pieces containing a precracked substrate layer with a thickness of 15 mm and a road carpet with a thickness of 30 mm, between which was inserted a control crack anti-rise system consisting of a geotextile sheet impregnated with a bituminous binder of asphalt/polymer type.

EXAMPLE 3: Test pieces containing a precracked substrate layer with a thickness of 15 mm and a road carpet with a thickness of 30 mm, between which was inserted a crack anti-rise system according to the invention, the said system being formed from a layer consisting of a geotextile sheet impregnated with a bituminous binder of asphalt/polymer type lying on the substrate layer and surmounted by a layer with a thickness of 20 mm of sand coated with an asphalt/polymer binder, this layer of coated sand being surmounted by the road carpet.

The transversely precracked substrate layer of the various test pieces was produced from the same bituminous concrete based on sand, asphalt and sulphur.

The road carpet of the various test pieces consisted of a non-continuous 0/10 bituminous concrete formed from 6 parts by weight of an asphalt/polymer composition vulcanized with sulphur and from 100 parts by weight of a mixture consisting, by weight, of 60% 6/10 mm gravel, 10% 0/4mm sand, 27.5% 0/2 mm sand and 2.5% added fines (80% of the said fines passing through an 80 μm sieve and 100% passing through a 315 μm sieve).

The asphalt/polymer composition used for producing the road carpet of the test pieces was prepared as follows. 100 parts by weight of a 180/220 asphalt with a penetration equal to 200 was mixed, at 170° C. and with stirring, with 3 parts by weight of a disequenced butadiene/styrene copolymer having a viscosity-average molecular mass equal to 75,000 and a styrene content by weight equal to 25%, then, after mixing for 3.5 hours, 0.1 part by weight of sulphur was added to the mass obtained and stirring was continued at a temperature of 170° C. for a further 30 minutes.

The asphalt/polymer composition obtained had a dynamic viscosity at 100° C. equal to 8.5 Pa.s.

The geotextile sheet impregnated with asphalt-/polymer bituminous binder, used in the test pieces of Examples 2 and 3, consisted of a sheet of a nonwoven made of isotactic polypropylene yarns having a g.s.m. of 170 g/m$^2$ impregnated with 900 g/m$^2$ of an asphalt-/polymer binder having a dynamic viscosity at 100° C. equal to 1 Pa.s , the said binder being applied to the sheet in the form of an aqueous emulsion.

This asphalt/polymer binder was prepared as follows. A mother solution was first of all formed by incorporating, at 100° C. and with stirring, 2.4 parts by weight of orthorhombic crystalline sulphur and 62 parts by weight of the disequenced styrene/butadiene copolymer defined above with 230 parts by weight of a petroleum fraction of naphthene/paraffin nature having an ASTM initial and an ASTM final distillation point (ASTM standard D8 667) equal respectively to 162° C. and 233° C., the said incorporation being carried out over 1 hour. The mother solution thus obtained was then incorporated with 1,950 parts by weight of an asphalt with a penetration equal to 82, maintained at 170° C. with stirring, after which the mixture thus produced was maintained at 170° C. with stirring for a further 30 minutes.

The fluxed asphalt/polymer binder (dynamic viscosity at 100° C. equal to 1 Pa.s) thus obtained was then converted to an aqueous emulsion as shown in Example 3 of the citation FR-A-2,577,546 to produce the asphalt-/polymer binder emulsion used to impregnate the geotextile sheet.

The layer of sand coated with asphalt/polymer binder present in the test pieces of Example 3 was formed from 9 parts by weight of asphalt/polymer binder consisting of the same asphalt/polymer composition as that used in constructing the road carpet and from 100 parts by weight of a mixture consisting, by weight, of 44% 2/6 mm gravel, 53% 0/2 mm sand and 3% added fines of the same nature as those used to produce the road carpet.

The results of the tests, both control and according to the invention, are collated in the table below.

TABLE

| Examples | Crack anti-rise system | $t_{R2}$ (min) |
|---|---|---|
| 1 | None | 360 |
| 2 | Geotextile impregnated with bituminous binder of the asphalt/polymer type | 450 |
| 3 | Geotextile impregnated with bituminous binder of the asphalt/polymer type + Sand coated with asphalt/polymer binder | 730 |

Comparison of the results recorded in the table clearly reveals the greatly improved efficiency of a crack anti-rise system according to the invention (Example 3) with respect to a crack anti-rise system according to the state of the art (Example 2).

We claim:

1. Crack anti-rise system inserted between the structural layer and the road carpet of a carriageway, of the type containing a layer of a geotextile impregnated with a first bituminous binder, which it also includes a layer of aggregates coated with a second bituminous binder, which is joined to the layer of geotextile impregnated with the first bituminous binder wherein between the structural layer and the road carpet of the carriageway, the layer of aggregates coated with the second bituminous binder lies on the structural layer of the carriageway, and whereas the layer of geotextile coated with the first bituminous binder is covered by the road carpet.

2. System according to claim 1, which is arranged so that, between the structural layer and the road carpet of the carriageway, the layer of geotextile impregnated with the first bituminous binder lies on the structural layer of the carriageway, whereas the layer of aggregates coated with the second bituminous binder is covered by the road carpet.

3. System according to one of claim 1, wherein the bituminous binder is used in the molten state or in the form of an aqueous emulsion in order to impregnate the geotextile and to coat the aggregates.

4. System according to one of claim 1, wherein the geotextile consists of a tightly-structured textile sheet having a mass per unit area of between 50 and 500 g/m$^2$.

5. System according to claim 4, wherein the textile sheet consists of a nonwoven formed from continuous filaments based on a polymer.

6. System according to claim 5, wherein the filaments forming the nonwoven sheet are based on a polyester, for example poly(alkylene terephthalate) such as poly(ethylene terephthalate), or on a polyamide, for example Nylon-6 or Nylon-6,6, or alternatively on isotactic polypropylene.

7. System according to one of claim 1, wherein the first bituminous binder which impregnates the geotextile is used in an amount of between 200 g and 1,500 g and preferably between 300 g and 1,000 g per $m^2$ of geotextile sheet.

8. System according to one of claim 1, wherein the second bituminous binder, in combination with the aggregates, in order to form the coated layer, is used in an amount of between 3 and 20% and more particularly between 4 and 12% of the weight of the aggregates.

9. System according to one of claim 1, wherein the layer of aggregates coated with the second bituminous binder consists of a layer of sand coated with the said binder.

10. System according to claim 9, wherein the sand used to form the layer of coated sand is chosen from the sands which are used on roadworks and for which the proportion passing through a 6 mm sieve is greater than 80% and preferably equal to 100%.

11. System according to one of claim 1, characterized in that the layer of aggregates coated with the second bituminous binder consists of a surfacing run on while cold.

12. System according to claim 11, wherein the surfacing run on while cold consists of an aggregate component, chosen from the sands which are used on roadworks and for which the proportion passing through a 6 mm sieve is greater than 80%, coated with the second bituminous binder, used as an aqueous emulsion, after having been brought into contact beforehand with a surface-active solution and optionally with an amount of cement of less than 3% of the weight of the sand forming the aggregate component.

13. System according to one of claim 1, wherein the layer of aggregates coated with the second bituminous binder consists of a draining surfacing.

14. System according to claim 13, wherein the draining surfacing consists of an aggregate component, chosen from chippings which are used on roadworks and for which the proportion passing through a 20 mm sieve is greater than 90%, coated while hot with the second bituminous binder so as to provide, after compacting, a void content in the surfacing of between 15% and 35% and preferably between 20% and 30%.

15. System according to one of claim 1, wherein the first bituminous binder, which impregnates the geotextile, and the second bituminous binder, which coats the aggregates, are identical or different in nature and are chosen from pure asphalts and asphalts modified by polymers which have a dynamic viscosity at 100° C. of between 0.4 Pa.s and 25 Pa.s and preferably between 0.7 Pa.s and 20 Pa.s.

16. System according to claim 15, wherein the first and the second bituminous binders are chosen from asphalts modified by copolymers of styrene and of a conjugated diene and in particular from asphalts modified by block copolymers of styrene and of a conjugated diene such as butadiene, isoprene or carboxylated butadiene.

17. Process for the production of a crack anti-rise system, inserted between the structural layer and the road carpet of a carriageway, the said system containing a layer of a geotextile impregnated with a first bituminous binder and joined to a layer of aggregates coated with a second bituminous binder, said process being characterized in that one of the layers of the crack anti-rise system is applied to the structural layer of the carriageway, the layer thus formed is then covered using the other layer of the crack anti-rise system and the road carpet is applied to the construction thus formed and first of all applying the layer of geotextile impregnated with the first bitumious binder to the structural layer of the carriageway, then covering said geotextile layer with the layer of aggregates coated with the second bitumious binder, and applying the road carpet of the carriageway to the last layer.

18. Process according to one of claim 17, wherein the road carpet contains a binder consisting of a pure asphalt or of an asphalt modified by a polymer and especially by a block copolymer of styrene and of a conjugated diene such as butadiene, isoprene or carboxylated butadiene.

19. Process according to one of claim 17, wherein the structural layer of the carriageway being cracked, the widest cracks, especially cracks with a width greater than 2 mm, are blocked up using a bituminous mastic before applying the layer of impregnated geotextile or the layer of coated aggregates of the crack anti-rise system to said structural layer.

20. Process according to claim 17, characterized in that the layer of aggregates coated with the second bituminous binder is first of all applied to the structural layer of the carriageway, said layer of coated aggregates is then covered with the layer of geotextile impregnated with the first bituminous binder and the road carpet of the carriageway is applied to this last layer.

21. Process according to one of claim 17, wherein the geotextile consists of a tightly-structured textile sheet having a mass per unit area of between 50 and 500 $g/m^2$.

22. Process according to claim 21, wherein the textile sheet consists of a nonwoven formed from continuous filaments based on a polymer.

23. Process according to claim 22, wherein the filaments forming the nonwoven sheet are based on a polyester, for example poly(alkylene terephthalate) such as poly(ethylene terephthalate), or on a polyamide, for example Nylon-6 or Nylon-6,6, or alternatively on isotactic polypropylene.

24. Process according to one of claim 17, wherein the amount of the first bituminous binder which impregnates the geotextile is between 200 g and 1,500 g and preferably between 300 g and 1,000 g per $m^2$ of geotextile sheet.

25. Process according to one of claim 17, wherein the amount of second bituminous binder which coats the aggregates is between 3 and 20% and more particularly between 4 and 12% of the weight of the said aggregates.

26. Process according to one of claim 17, wherein the layer of aggregates coated with the second bituminous binder consists of a layer of sand coated with the said binder or else of a surfacing run on while cold or alternatively of a draining surfacing.

27. Process according to one of claim 17, wherein the first and the second bituminous binders are chosen from pure asphalts and asphalts modified by polymers which have a dynamic viscosity at 100° C. of between 0.4 Pa.s and 25 Pa.s and preferably between 0.7 Pa.s and 20 Pa.s, the said bituminous binders being more particularly asphalts modified by copolymers of styrene and of a conjugated diene, the said copolymers being more especially block copolymers of styrene and of a conjugated diene such as butadiene, isoprene or carboxylated butadiene.

28. Process according to one of claim 17, wherein the bituminous binder is used in the molten state or in the form of an aqueous emulsion in order to impregnate the geotextile and to coat the aggregates.

* * * * *